US005708913A

United States Patent [19]

Yasuhara et al.

[11] Patent Number: 5,708,913

[45] Date of Patent: Jan. 13, 1998

[54] COATING APPARATUS, PROCESS CARTRIDGE AND ELECTROPHOTOGRAPHIC IMAGE FORMING APPARATUS

[75] Inventors: Masateru Yasuhara, Yokohama; Tadayuki Tsuda, Hachioji; Akira Higeta, Funabashi; Hiroshi Koyama, Yokohama, all of Japan

[73] Assignee: Canon Kabushiki Kaisha, Tokyo, Japan

[21] Appl. No.: 595,483

[22] Filed: Feb. 1, 1996

[30] Foreign Application Priority Data

Feb. 2, 1995 [JP] Japan ..... 7-015798

[51] Int. Cl.[6] ..... G03G 15/00

[52] U.S. Cl. ..... 399/38; 156/356; 264/259; 318/568.18; 318/570; 364/476; 399/106; 901/16

[58] Field of Search ..... 355/210, 215; 156/356, 578; 264/259; 901/16, 43; 414/749; 318/570, 573, 574, 575, 568.11, 568.16, 568.18; 364/174, 474.13, 474.29, 474.3, 476

[56] References Cited

U.S. PATENT DOCUMENTS

| | | | |
|---|---|---|---|
| 3,748,563 | 7/1973 | Pomella et al. | 318/573 |
| 4,547,996 | 10/1985 | Winski | 364/474.3 X |
| 4,593,366 | 6/1986 | Sugimoto et al. | 318/573 X |
| 4,696,256 | 9/1987 | Lenhardt | 156/578 X |
| 4,772,831 | 9/1988 | Casler, Jr. et al. | 318/568.18 X |
| 5,208,634 | 5/1993 | Ikemoto et al. | 355/215 |
| 5,294,960 | 3/1994 | Nomura et al. | 355/210 |
| 5,444,636 | 8/1995 | Yoshida et al. | 364/474.3 |
| 5,521,477 | 5/1996 | Sasaki | 318/568.18 |
| 5,561,504 | 10/1996 | Watanabe et al. | 355/215 |

FOREIGN PATENT DOCUMENTS 5134488 5/1993 Japan .

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A coating apparatus for coating liquid-form material to be solidified as an elastomer on a coated member in order to form a seal member for preventing toner leakage, includes an injection member for injecting the liquid-form material on the coated member, a holder for holding the coated member, a driver for causing relative movement between the injection member and the holder, and a controller for controlling the driver to change the relative movement between the injection member and the holder.

38 Claims, 14 Drawing Sheets

```
ROBOT PROGRAM OF
OPERATION SAMPLE

  MOV  P (2)
 LMOV  P (3)  ; 1 + 4
 RMOV  P (4)  ; 1 + 4
 LMOV  P (5)  ; 1
 LMOV  P (6)  ; 1 + 4
 LMOV  P (7)  ; 1 + 4
 RMOV  P (8)  ; 1
 LMOV  P (9)
```

COATING APPARATUS, PROCESS CARTRIDGE AND ELECTROPHOTOGRAPHIC IMAGE FORMING APPARATUS

BACKGROUND OF THE INVENTION

1. Field of the Invention

The present invention relates to a coating apparatus for coating liquid-form material which can be solidified as an elastomer on a coated member (member to be coated) in order to form a seal member (which is used with an electrophotographic image forming apparatus) for preventing leakage of toner, a process cartridge having such a seal member formed from the liquid-form material coated by the coating apparatus, and an electrophotographic image forming apparatus.

The process cartridge incorporates therein a charge means, or a developing means or a cleaning means, and an electrophotographic photosensitive member as an unit which can be removably mounted to the electrophotographic image forming apparatus, or incorporates therein at least one of a charge means, a developing means and a cleaning means, and an electrophotographic photosensitive member as a unit which can be removably mounted to the electrophotographic image forming apparatus, or incorporates therein at least a developing means, and an electrophotographic photosensitive member as a unit which can be removably mounted to the electrophotographic image forming apparatus.

The electrophotographic image forming apparatus may be, for example, a laser beam printer, a copying machine, a facsimile system, a word processor and the like.

2. Related Background Art

In electrophotographic image forming apparatuses such as printers, an electrophotographic photosensitive member which was uniformly charged by a charger is selectively exposed to form a latent image. Then, the latent image is visualized with a developer (referred to as "toner" hereinafter) by a developing device as a toner image which is in turn transferred onto a recording medium, thereby executing recording of the image. In such apparatuses, conventionally, the maintenance of various parts was performed by expert persons.

To avoid this, for example, there has been proposed a technique in which an electrophotographic photosensitive member, a charger, a developing device and a cleaning device are contained within a cartridge frame to form a cartridge. By exchanging the used cartridge with a new one by an operator, the cartridge in which the toner was used up or consumed and/or the service life of the electrophotographic photosensitive member and the like which has expired can easily be changed and the maintenance can be facilitated.

In such process cartridges, the toner must be prevented from leaking outside. In the past, foam polyurethane such as MOLTPLANE (trade name) polyurethane was attached to one of engaging surfaces by a double-sided adhesive tape and the other engaging surface was urged against the foam polyurethane to compress the latter, thereby forming a seal.

However, it was difficult to automate the attaching of the foam polyurethane to the engaging surface. Thus, recently, in plane of the user of the foam polyurethane as a seal member, there has been proposed a technique in which liquid-form elastomer is poured on an engaging surface and then is solidified to form a seal member (refer to U.S. Pat. No. 5,208,634). This technique is very effective in a practical use.

The present invention relates to further improvement in this technique.

SUMMARY OF THE INVENTION

An object of the present invention is to provide a coating apparatus capable of effectively coating liquid-form material which can be solidified as elastomer on a coated member (member to be coated), a process cartridge having such a seal member formed from the liquid-form material coated by the coating apparatus, and an electrophotographic image forming apparatus using such a process cartridge.

Another object of the present invention is to provide a coating apparatus capable of coating liquid-form material which can be solidified as elastomer on a coated member uniformly as much as possible, a process cartridge having such a seal member formed from the liquid-form material coated by the coating apparatus, and an electrophotographic image forming apparatus using such a process cartridge.

A further object of the present invention is to provide a coating apparatus in which the relative shifting speed between an injection member for injecting liquid-form material onto a coated member and a holding member for holding the coated member can be changed, a process cartridge having such a seal member formed from the liquid-form material coated by the coating apparatus, and an electrophotographic image forming apparatus using such a process cartridge.

The other object of the present invention is to provide a coating apparatus in which, by changing the relative speed between a coating nozzle for liquid-form material and a coated member on the way of continuous traces or tracks at a connection between a straight track and an arc track, occurrence of overshoot in the track can be prevented, and, if the coated member is inclined, by delaying a coating speed at a top of the coated member, unevenness of the coating due to fluidity of the liquid-form material can be prevented, a process cartridge having such a seal member formed from the liquid-form material coated by the coating apparatus, and an electrophotographic image forming apparatus using such a process cartridge.

DETAILED DESCRIPTION OF THE PREFERRED EMBODIMENTS

The present invention will now be explained with reference to the accompanying drawings. First of all, a coating apparatus will be described, and then, a process cartridge and an electrophotographic image forming apparatus having seal member(s) formed from liquid-form material by using the coating apparatus will be described.

[Explanation of Coating Apparatus]

Figure 1:
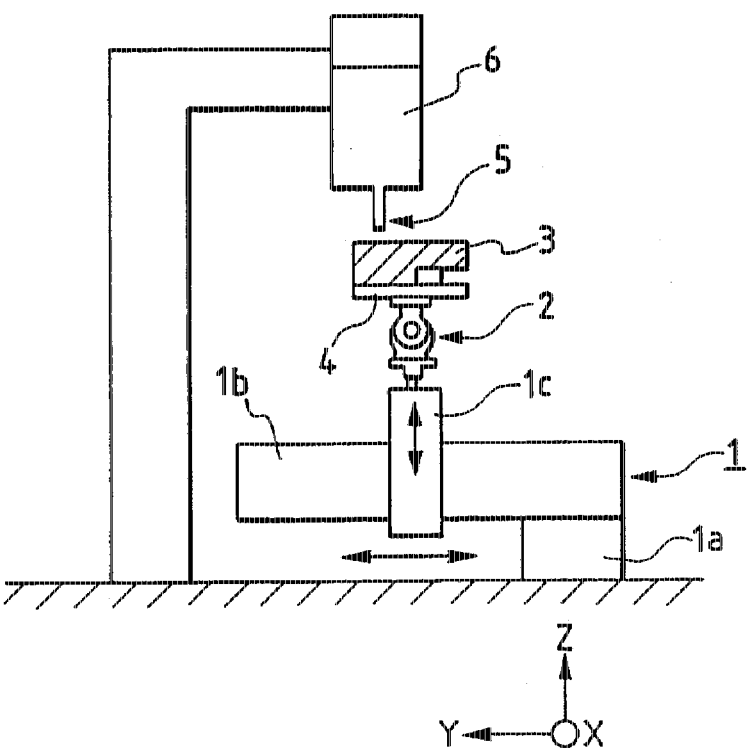
FIG. 1 is a schematic side view of a coating apparatus according to an embodiment of the present invention.
Figure 2:
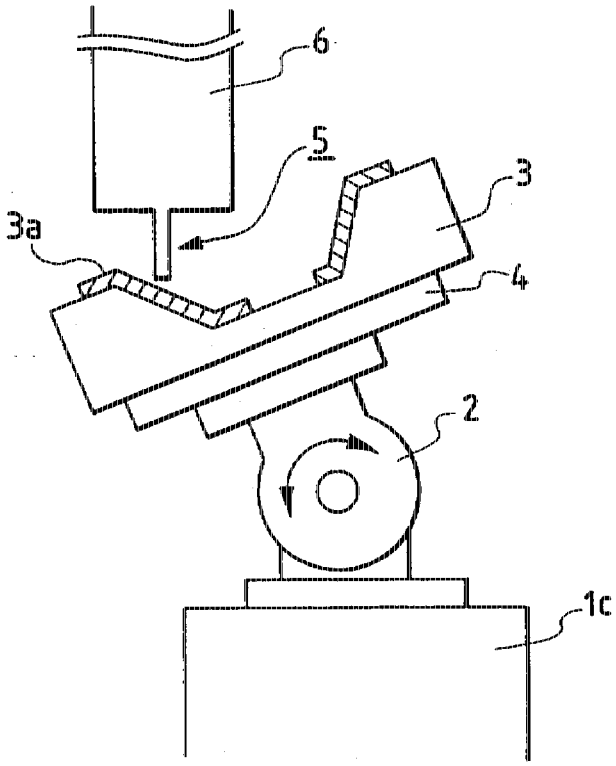
FIG. 2 is an enlarged view of a main portion of the coating apparatus.

FIG. 1 is a view showing a coating apparatus for coating liquid-form material onto a coated member (member to be coated), and FIG. 2 is an enlarged view of a main portion of the coating apparatus.

In the coating apparatus according to the illustrated embodiment, liquid-form material which is solidified after coating is used as sealing agent so that a continuous seal member is formed along a predetermined track on the coated member.

In FIGS. 1 and 2, a triaxial orthogonal robot 1 comprises an X-axis arm 1*a*, a Y-axis arm 1*b* and a Z-axis arm 1*c* so that, by controlling three axes independently, any three-dimensional track can be drawn by a tip end of the Z-axis arm 1*c*. A reversing unit (inclining means) 2 is attached to the tip end of the Z-axis arm 1*c*, and a work plate 4 for supporting a work (a coated member, i.e. member to be coated) 3 on which liquid-form material (for example, foam polyurethane) for forming a seal member is coated is attached to the reversing unit 2. A seal agent injecting device 6 is secured so that an injecting nozzle 5 is positioned above the work 3.

In this arrangement, when the robot 1 is moved along any track while injecting the seal agent from the injecting nozzle 5, the seal agent can be coated on a coating surface 3*a* of the work 3 with any shape.

Next, a coating operation for the seal agent will be explained. In FIG. 1, first of all, the reversing unit 2 is rotated by a control means which will be described later to position the coating surface 3*a* of the work 3 substantially in a horizontal plane. Then, the triaxial orthogonal robot 1 is operated to align a coating start position on the work 3 with a tip end of the injecting nozzle 5 of the seal agent injecting device 6. Thereafter, the seal agent is injected from the seal agent injecting device 6.

At the same time, the work 3 is moved by the triaxial orthogonal robot 1 in accordance with previously recorded command data. As a result, the seal agent injected from the seal agent injecting device 6 is coated on the coating surface of the work 3.

{Control Arrangement}

Figure 3:
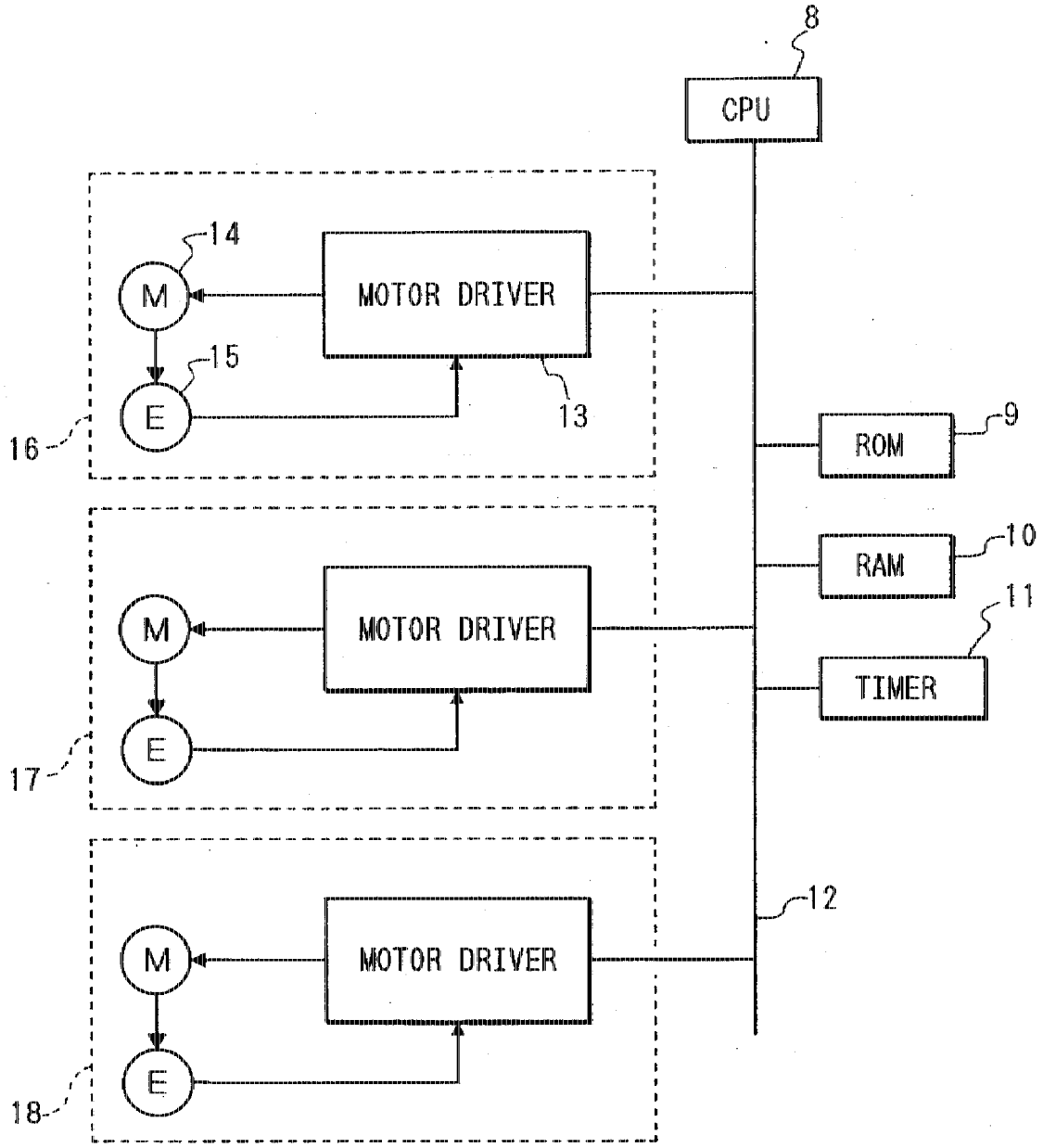
FIG. 3 is a block diagram of a control means.

The movement of the robot 1 is controlled by the control means having a construction as shown in FIG. 3. In FIG. 3, the control means comprises a CPU 8 acting as a control portion for executing analysis/calculation for controlling the robot 1, a ROM 9 for storing the commands carried out by the CPU 8, a RAM 10 acting as a memory portion for storing data, a timer 11 for measuring time, a bus 12 for sending the data, motor drivers 13 for driving motors 14 for operating the robot 1, and encoders 15 for detecting the positions of the motors. An X-axis unit 16 includes the corresponding motor driver 13, the motor 14 and the encoder 15, and Y-axis and the Z-axis units 17, 18 have the same construction. The CPU 8 successively interprets and carries out the commands stored in the ROM 9 to control the axis units 16, 17, 18, thereby operating the robot 1.

Next, the execution of the commands stored in the ROM 9 will be explained with reference to flow charts shown in FIGS. 4 to 7.

Figure 4:
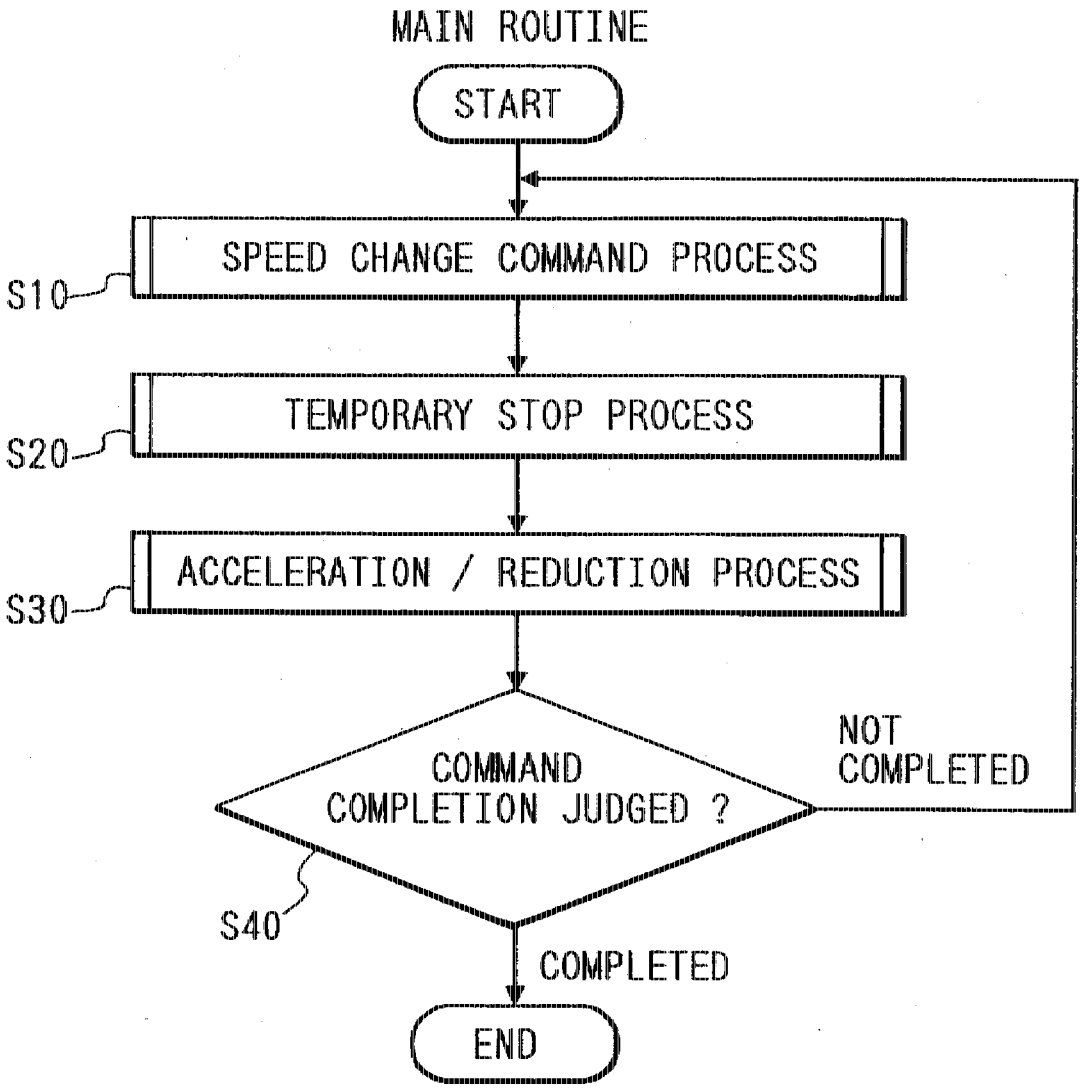
FIG. 4 is a flow chart showing a main routine of a control program.

FIG. 4 is a flow chart showing entire program. In the execution of the program, a speed change command process is treated in a speed change command process routine (step S10), a temporary stop process is treated in a temporary stop process routine (step S20), an acceleration/reduction process is treated in an acceleration/reduction process routine (step S30) in accordance with parameters determined by the speed change command process in the step S10. And, in a command completion judgement (step S40), it is judged whether the process of a series of track data is completed or not. If it is not completed, the program is returned to the step S10, whereas, if completed, the main routine is ended.

Figure 5:
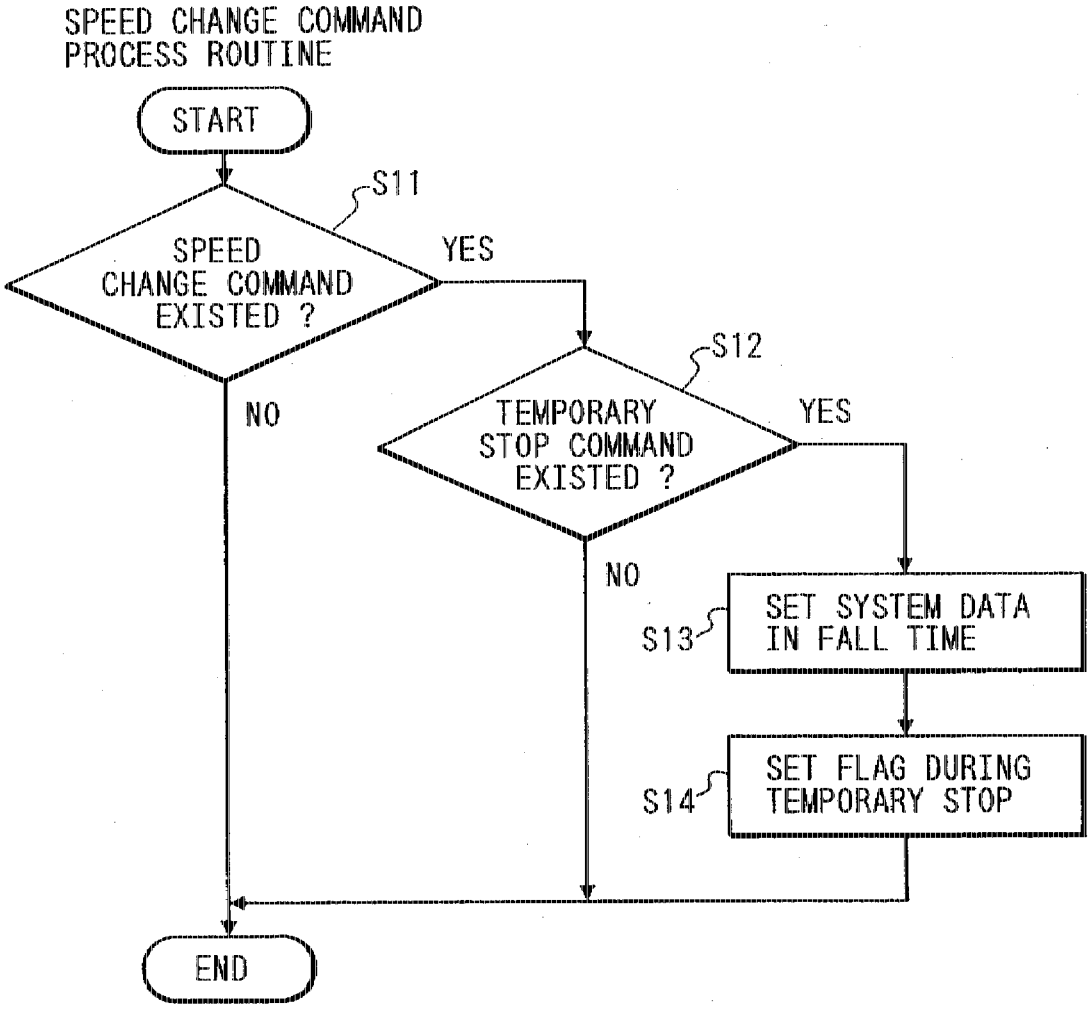
FIG. 5 is a flow chart showing a speed change command process routine.

Now, the processes shown in the above steps will be fully explained. The execution of the speed change command process routine in the step S10 is shown in FIG. 5. First of all, it is judged whether the given movement command for the robot 1 includes the speed change command (step S11). If the movement command includes the speed change command, it is judged whether the speed change command includes the temporary stop (step S12). If it includes the temporary stop, the value previously registered as the system data is set in a fall time (step S13) as a parameter sent to the acceleration/reduction process routine (step S30) of the program, and then, a flag is set during the temporary stop process (step S14) so that the value previously registered as the system data is set in a rise time during the interpretation of the movement command (step S14).

On the other hand, in the step S12, if there is no temporary stop command, the speed change command process routine is ended.

Figure 6:
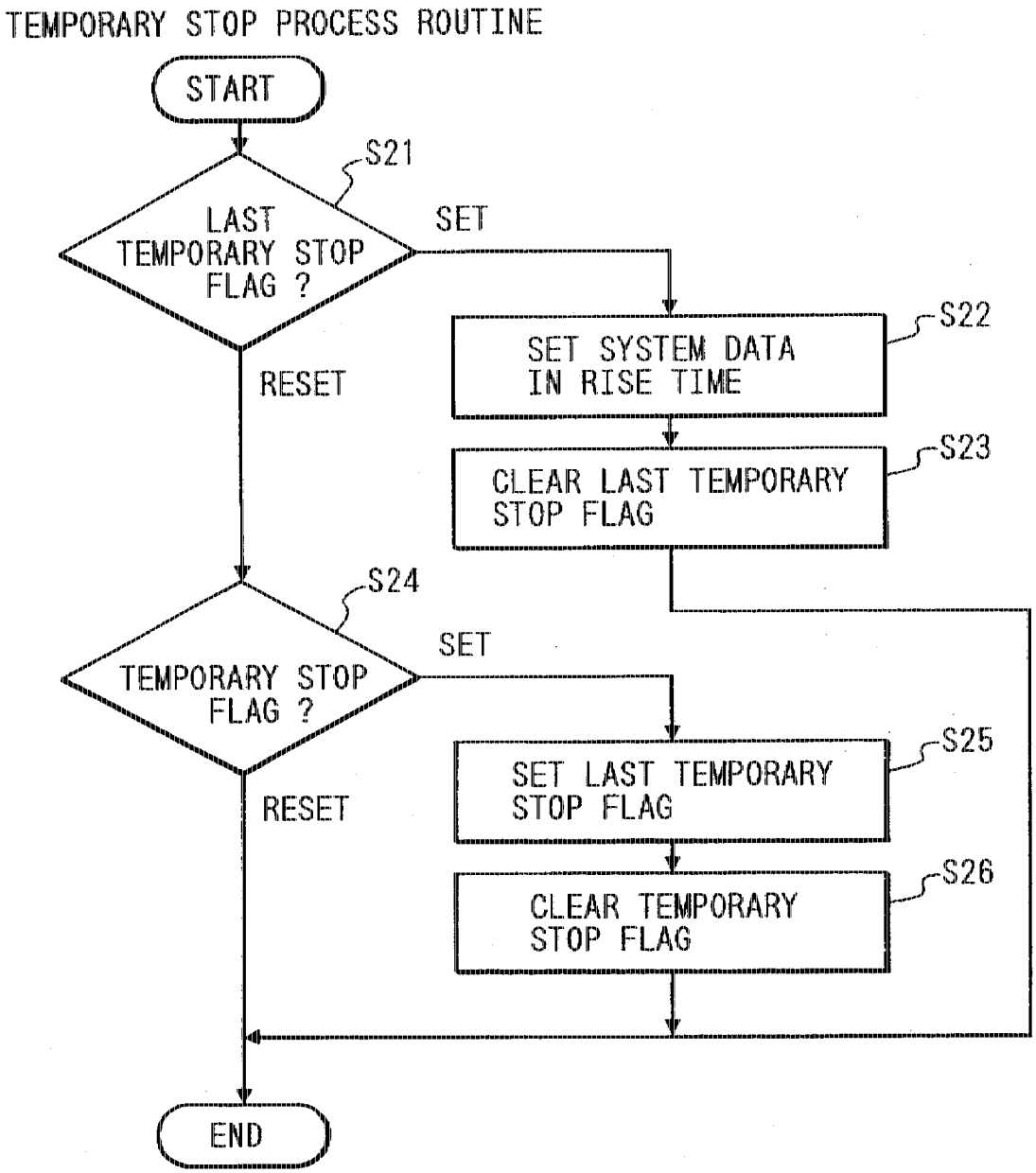
FIG. 6 is a flow chart showing a temporary stop process routine.

The execution of the temporary stop process routine in the step S20 is shown in FIG. 6. First of all, it is judged whether the last temporary stop flag is set or reset (step S21). If the last temporary stop flag was set, the value previously registered as the system data is set in a rise time (step S22), thereby clearing the last temporary stop flag (step S23).

On the other hand, if the last temporary stop flag was not set, the routine goes to a step S24, where it is judged whether the temporary stop flag is set or reset. If the temporary stop flag was set, the last temporary stop flag is set (step S25) in order to effect slow-up in the next acceleration/reduction process routine.

Figure 7:
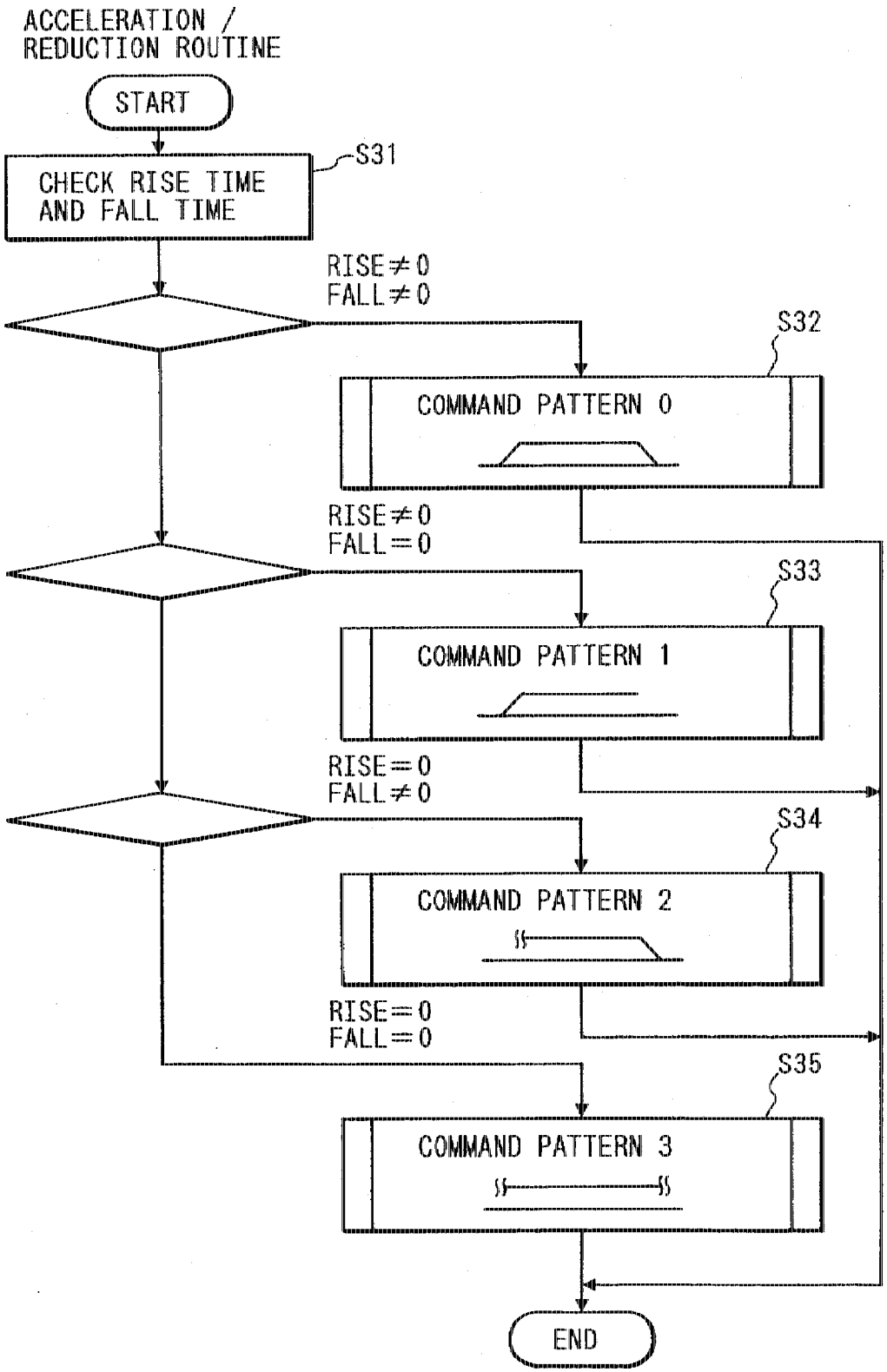
FIG. 7 is a flow chart showing an acceleration/reduction routine.

The execution of the acceleration/reduction process routine in the step S30 is shown in FIG. 7. First of all, the rise time and the fall time are checked (step S31) to effect either of the following four processes.

That is to say, if it is judged that both the rise time and the fall time are not zero, a treatment for generating a pattern including speeding up and slowing down as a command pattern is carried out (step S32). This pattern is used when the coating track is obtained by a single movement command for the robot and the like.

On the other hand, if it is judged that the rise time is not zero and the fall time is zero, a treatment for generating a pattern including speeding up and not including slowing down as a command pattern is carried out (Step S33). This pattern is used in an initial condition when the coating track is obtained by a plurality of movement commands for the robot and the like.

Thirdly, if it is Judged that the rise time is zero and the fall time is not zero, a treatment for generating a pattern not including speeding up and including slowing down as a command pattern is carried out (step S34). This pattern is used in a last condition when the coating track is obtained by a plurality of movement commands for the robot and the like.

Lastly, if it is judged that both the rise time and the fall time are zero, a treatment for generating a pattern not including both speeding up and slowing down as a command pattern is carried out (step S35). This pattern is used in an intermediate condition when the coating track is obtained by a plurality of movement commands for the robot and the like.

{Concrete Example of Coating Speed Change Track}

Figure 8A:
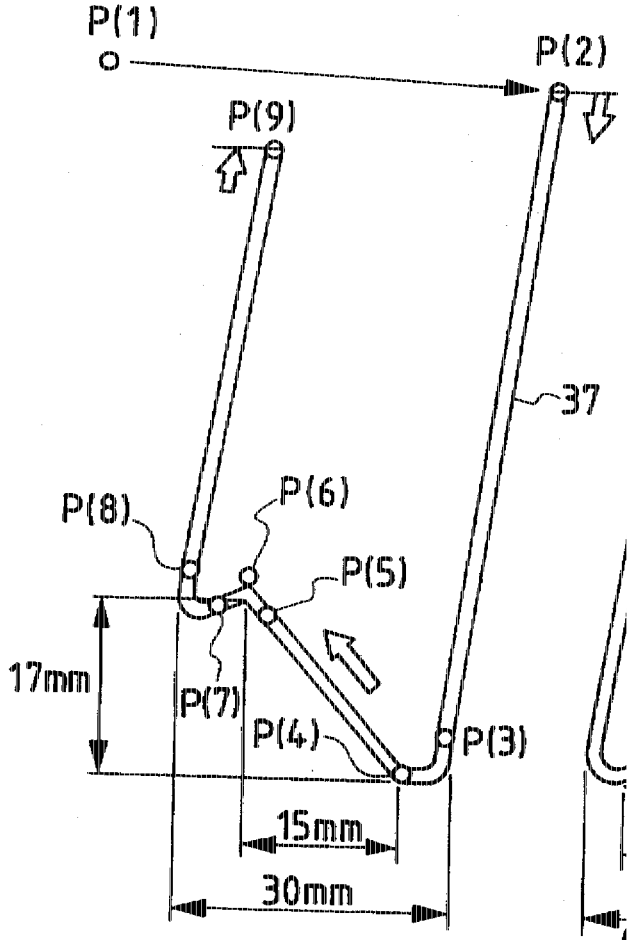
FIGS. 8A and 8B are explanatory views showing an example of a coating track.
Figure 8B:
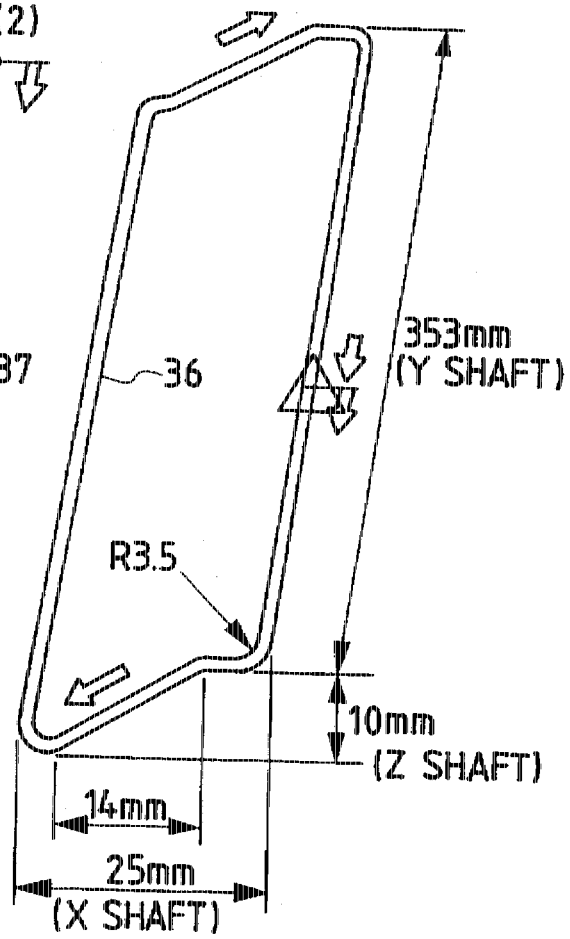
Figures 9, 10:
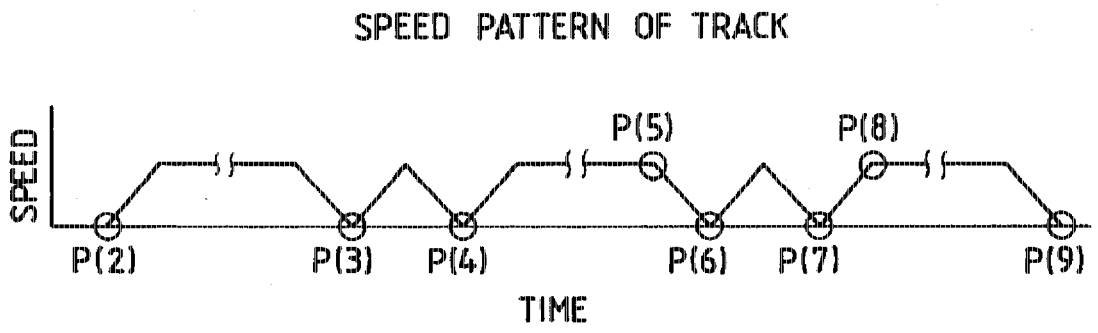
FIG. 9 is a view showing a robot program of operation sample.
FIG. 10 is a view showing a speed pattern of track.

Now, as a concrete example of the coating track in which the coating speed is changed on the way will be explained with reference to FIGS. 8A to 10 showing a case where the robot is moved along a track obtained by connecting eight teaching points by five lines and one arc. Incidentally, FIGS. 8A and 8B are explanatory views showing teaching points for operation, FIG. 9 shows a robot program of an operation sample, and FIG. 10 is a graph showing a speed pattern of track.

First of all, the robot command of "MOV P(2)" in the program is interpreted. This command means that the robot should be moved to the teaching point P(2) without designating the coating track.

Since this command is not continuous command, in the acceleration/reduction process (step S30), the speed pattern including the speeding up and slowing down is generated. Thus, the speed of the robot 1 is increased with speeding up from a present position P(1) toward the point P(2) until a designated speed is reached, and then, the speed of the robot is decreased with a slowing down to stop at the point P(2). Then, in the command completion judgment (step S40), it is judged whether the command is completed or not. In this case, since there are succeeding commands to be treated, it is judged that the command is not completed, and the speed change command process (step S10) is repeated.

Then, the robot command of "LMOV P(3); 1+4" is interpreted. This command means that the robot should be moved to the teaching point P(3) with continuous command in the straight track under the condition that acceleration/reduction is carried out at the point P(3).

In this case, the parameter "1" indicates the continuous command and the parameter "4" indicates the execution of the acceleration/reduction. In this condition, since the continuous command is used and the temporary stop command is given, in the speed change command process (step S10), the system data is set in the fall time, and, the flag is set during the temporary stop process in order to set the value registered as the system data in the rise time of the next movement command. Thus, in the acceleration/reduction process (step S30), the speed pattern including the speeding up and slowing down is generated. As a result, the speed of the robot 1 is increased with speeding up from the present position toward the point P(3) in the straight track until a designated speed is reached, and then, the speed of the robot is decreased with a slowing down to become zero at the point P(3). Then, in the command completion judgment (step S40), it is judged whether the command is completed or not. In this case, since there are succeeding commands to be treated, it is judged that the command is not completed, and the speed changed command process (step S10) is repeated.

Then, the robot command of "RMOV P(4); 1+4" is interpreted. This command means that the robot should be moved to the teaching point P(4) with continuous command in the arc track under the condition that acceleration/reduction is carried out at the point P(4).

In this case, the parameter "1" indicates a continuous command and the parameter "4" indicates the execution of the acceleration/reduction. In this condition, since the continuous command is used and the temporary stop command is given, in the speed change command process (step S10), the system data is set in the fall time, and, the flag is set during the temporary stop process in order to set the value registered as the system data in the rise time of the next movement command. Thus, in the acceleration/reduction process (step S30), the speed pattern including the speeding up and slowing down is generated. As a result, the speed of the robot 1 is increased with speeding up from the present position toward the point P(4) in the arc track until a designated speed is reached, and then, the speed of the robot is decreased with a slowing down to become zero at the point P(4). Then, in the command completion judgment (step S40), it is judged whether the command is completed or not. In this case, since there are succeeding commands to be treated, it is judged that the command is not completed, and the speed change command process (step S10) is repeated.

Then, the robot command of "LMOV P(5); 1" is interpreted. This command means that the robot should be moved to the teaching point P(5) with continuous command in the straight track.

In this case, the parameter "1" indicates the continuous command. In this condition, since the continuous command is used, in the speed change command process (step S10), no treatment is effected. Thus, in the acceleration/reduction process (step S30), the speed pattern including the speeding up and not including a slowing down is generated. As a result, the speed of the robot 1 is increased with speeding up from the present position toward the point P(5) in the straight track until a designated speed is reached. Then, in the command completion judgment (step S40), it is judged whether the command is completed or not. In this case, since there are succeeding commands to be treated, it is judged that the command is not completed, and the speed change command process (step S10) is repeated.

Then, the robot command of "LMOV P(6); 1+4" is interpreted. This command means that the robot should be moved to the teaching point P(6) with a continuous command in the straight track under the condition that acceleration/reduction is carried out at the point P(6).

In this case, the parameter "1" indicates the continuous command and the parameter "4" indicates the execution of the acceleration/reduction. In this condition, since the continuous command is used and the temporary stop command is given, in the speed change command process (step S10), the system data is set in the fall time, and, the flag is set during the temporary stop process in order to set the value registered as the system data in the rise time of the next movement command. Thus, in the acceleration/reduction process (step S30), the speed pattern not including speeding up and including slowing down is generated. As a result, the speed of the robot 1 is increased with speeding up from the present position toward the point P(6) in the straight track until a designated speed is reached, and then, the speed of the robot is decreased with slowing down to become zero at the point P(6). Then, in the command completion judgment (step S40), it is judged whether the commands is completed or not. In this case, since there are Succeeding commands to be treated, it is judged that the command is not completed, and the speed change command process (step S10) is repeated.

Then, the robot command of "LMOV P(7); 1+4" is interpreted. This command means that the robot should be moved to the teaching point P(7) with a continuous command in the straight track under the condition that acceleration/reduction is carried out at the point P(7).

In this case, the parameter "1" indicates the continuous command and the parameter "4" indicates the execution of the acceleration/reduction. In this condition, since the continuous command is used and the temporary stop command is given, in the speed change command process (step S10), the system data is set in the fall time, and, the flag is set during the temporary stop process in order to set the value registered as the system data in the rise time of the next movement command. Thus, in the acceleration/reduction process (step S30), the speed pattern including speeding up and slowing down is generated. As a result, the speed of the robot 1 is increased with speeding up from the present position toward the point P(7) in the straight track until a designated speed is reached, and then, the speed of the robot is decreased with slowing down to become zero at the point P(7). Then, in the command completion judgment (Step S40), it is judged whether the command is completed or not. In this case, since there are succeeding commands to be treated, it is judged that the command is not completed, and the speed change command process (step S10) is repeated.

Then, the robot command of "RMOV-P(8); 1" is interpreted. This command means that the robot should be moved to the teaching point P(8) with a continuous command in the arc track.

In this case, the parameter "1" indicates the continuous command. In this condition, since the continuous command is used, in the speed change command process (step S10), no treatment is effected. Thus, in the acceleration/reduction process (step S30), the speed pattern including the speeding up and not including slowing down is generated. As a result, the speed of the robot 1 is increased with speeding up from the present position toward the point P(8) in the arc track until a designated speed is reached. Then, in the command completion judgment (step S40), it is judged whether the command is completed or not. In this case, since there is a succeeding command to be treated, it is judged that the command is not completed, and the speed change command process (step S10) is repeated.

Lastly, the robot command of "LMOV P(9)" in the program is interpreted. This command means that the robot should be moved to the teaching point P(9) in the straight track.

Since this command is not a continuous command, in the acceleration/reduction process (step S30), the speed pattern is not including the speeding up and including the slowing down is generated. Thus, the robot 1 is moved from the present position toward the point P(9) at a designated speed, and then, the speed of the robot is decreased with slowing down to stop at the point P(9). Then, in the command completion judgment (step S40), it is judged whether the command is completed or not. In this case, since there is no succeeding command to be treated, the main routine is ended. Incidentally, dimensions shown in FIGS. 8A and 8B indicate distances that the robot is moved in the illustrated embodiment.

By controlling the movement of the robot 1 as mentioned above, the moving speed of the robot can be changed at the connecting points between the straight track and the arc track or at the top of the inclined surface, thereby preventing the overshoot of the apparatus at the arc portion.

Further, when the coated member on which the seal member is coated includes the inclined surface, by decreasing the coating speed at the top of the inclined surface, the liquid-form material having fluidity can be coated even on the top without unevenness.

[Explanation of Process Cartridge and Electrophotographic Image Forming Apparatus]

Now, a case where the seal member is coated and formed on the process cartridge by the coating apparatus the movement of which is controlled as mentioned above will be explained with reference to FIGS. 11 to 15.

First of all, the process cartridge and the electrophotographic image forming apparatus having such a process cartridge will be explained, and then the seal member of the process cartridge will be explained.

{Entire Construction}

Figure 11:
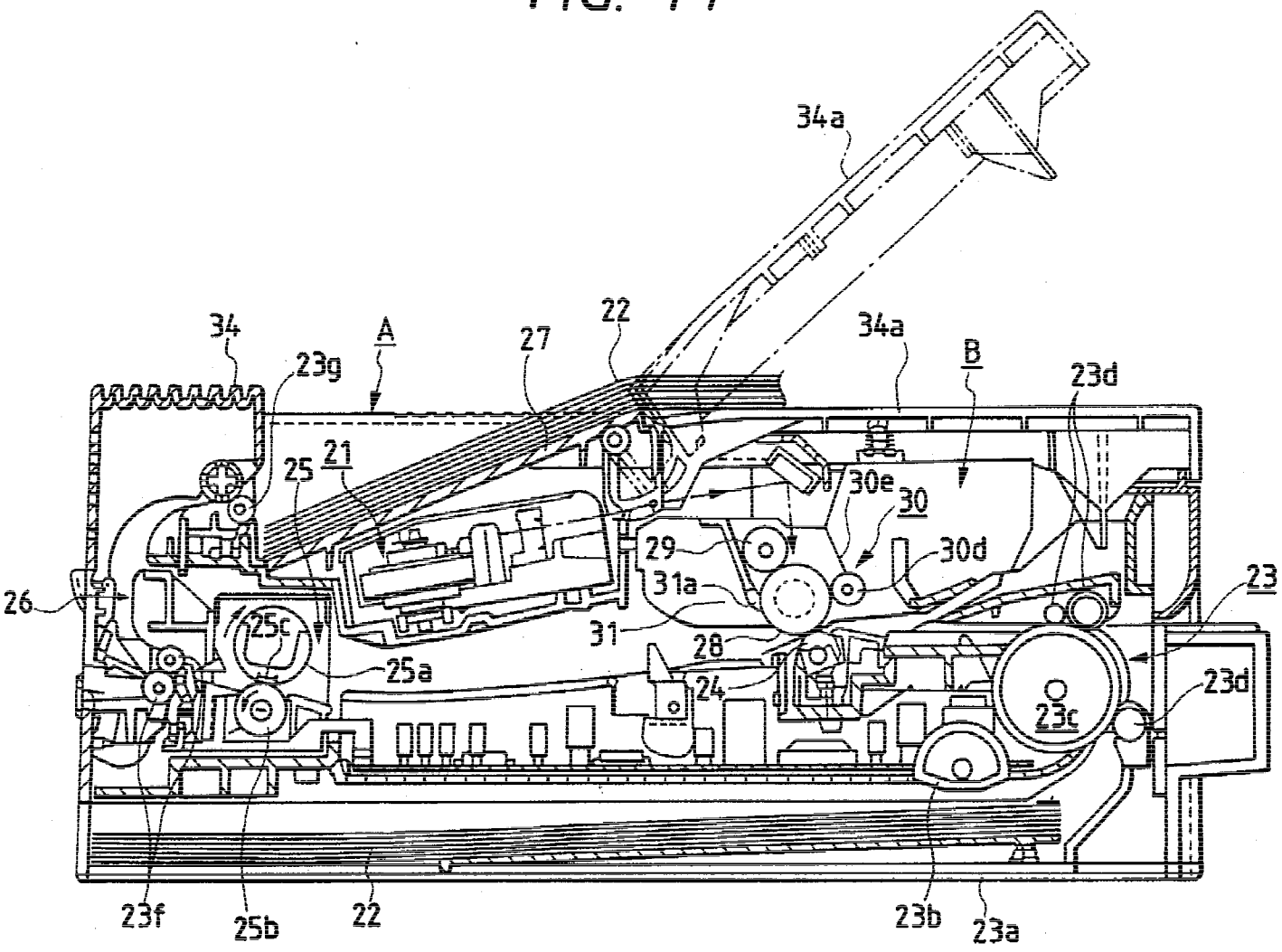
FIG. 11 is an elevational sectional view of an image forming apparatus.

As shown in FIG. 11, in the electrophotographic image forming apparatus (laser beam printer) A, information light corresponding to image information from an optical system 21 is illuminated on a drum-shaped electrophotographic photosensitive member to form a latent image on the photosensitive member. Then, the latent image is developed to form a toner image. Synchronously with the formation of the toner image, a recording medium 22 is supplied and conveyed from a cassette 23*a* by a convey means 23 comprising a pick-up roller 23*b*, a reverse rotation roller 23*c* and a pinch roller 23*d* urged against the reverse rotation roller and driven by rotation of the reverse rotation roller. When the recording medium 22 reaches the electrophotographic photosensitive member incorporated into a process cartridge B, by applying voltage to a transfer roller (transfer means) 24, the toner image formed on the electrophotographic photosensitive member is transferred onto the recording medium 22. After the transferring of the toner image, the recording medium 22 is sent, through a guide plate, to a fixing means 25 comprising a fixing rotary member 25*a* having a heater 25*c* therein and a drive roller 25*b* for urging the recording medium 22 against the fixing rotary member 25*a* to convey the recording medium. In the fixing device 25, the toner image is permanently fixed to the recording medium 22. Thereafter, the recording medium 22 is conveyed by a pair of discharge rollers 23*f* and a pair of discharge rollers 23*g* and is discharged into a discharge portion 27 through a reverse rotation convey path 26.

Figure 12:
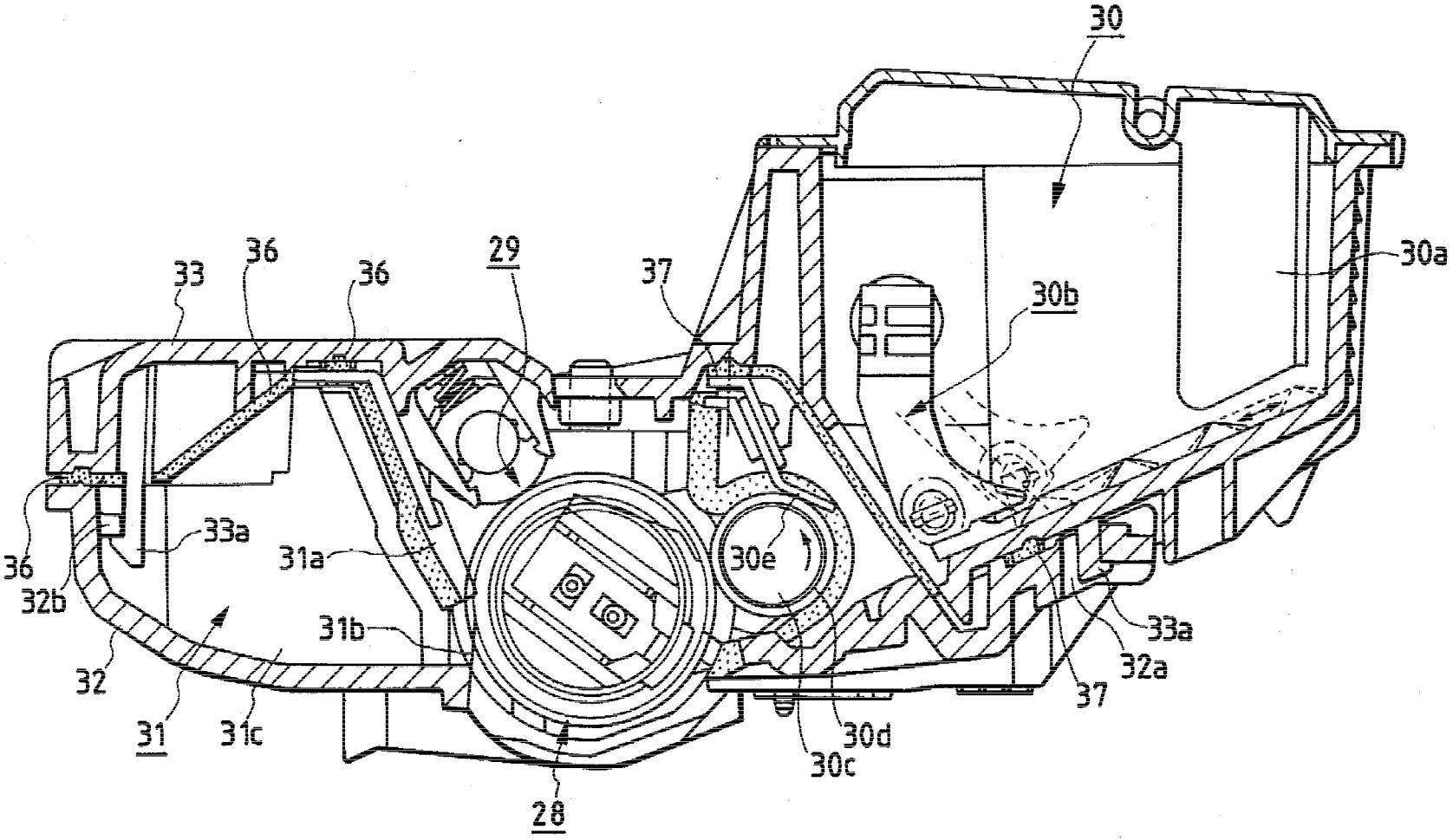
FIG. 12 is a sectional view of a process cartridge.

On the other hand, as shown in FIG. 12, in the process cartridge B, the electrophotographic photosensitive member, i.e. photosensitive drum 28 having a photosensitive layer thereon is rotated; meanwhile, a surface of the photosensitive drum 28 is uniformly charged by applying voltage to the charger (charge means) 29. Then, the photosensitive drum 28 is exposed by the information light from the optical system 21 through an exposure portion, thereby forming the latent image. The latent image is then developed by a developing means 30.

In the developing means 30, toner contained in a toner containing portion 30*a* is fed by a toner feed member 30*b* to a rotating developing roller 30*d* having a fixed magnet 30*c* therein. Then, a toner layer is formed on a surface of the developing roller 30*d* by a developing blade 30*e* while applying friction charge to the toner layer. By transferring the toner from the toner layer to the latent image formed on the photosensitive drum 28, the latent image is visualized as a toner image. After the toner image is transferred onto the recording medium 22 by applying to the transfer roller 24 voltage having polarity opposite to that of the toner image, the residual toner remaining on the photosensitive drum 28 is removed from the photosensitive drum 28 by the cleaning means 31 comprising a cleaning blade 31*a* for scraping the residual toner away from the drum, a dip sheet 31*b* for receiving the removed toner (waste toner) and a waste toner containing portion 31*c* for collecting the waste toner.

Incidentally, the above-mentioned various elements such as the photosensitive drum 28 are housed and supported within a housing obtained by interconnecting upper and lower frames 33, 32 to each other, thereby providing a cartridge which can removably be mounted to a cartridge mounting means provided within a body 34 of the image forming apparatus.

Figure 13:
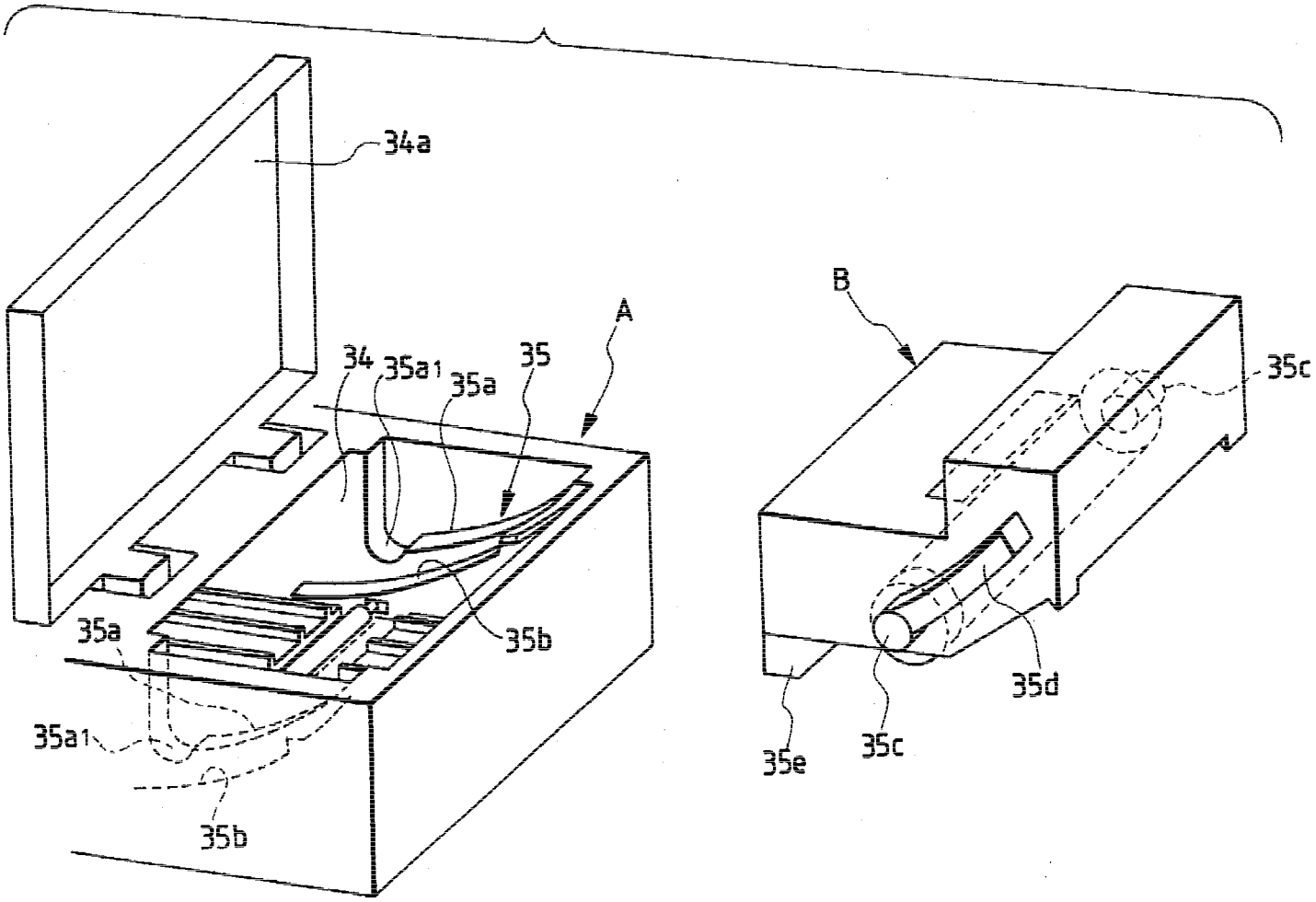
FIG. 13 is a perspective view for explaining mounting of the process cartridge.

Regarding the cartridge mounting means, as shown in FIG. 13, when an open/close member 34*a* is opened, there is provided a cartridge mounting space within the apparatus body 34, and a pair of cartridge mounting guide portions 35 are formed on inner side surfaces of the apparatus body 34. Each guide portion 35 includes first and second guide rails 35*a*, 35*b* for guiding the insertion of the process cartridge B. On the other hand, the process cartridge B is provided at its outer side surfaces with cylindrical projections 35*c* each protruding outwardly in alignment with a rotation axis of the photosensitive drum 28 and having a radius substantially the same as a radius of a recessed portion 35*a*1 of each first guide rail 35*a*, and guide ridges 35*d* contiguous to the respective cylindrical projections 35*c*. Further, an engagement portion 35*e* is formed on a lower portion of a front (in a cartridge inserting direction) surface of the process cartridge B.

When the process cartridge B is mounted to the apparatus body, the process cartridge B is inserted into the cartridge mounting space while guiding the cylindrical projections 35*c* and the guide ridges 35*d* by means of the first guide rails 35*a* and guiding the engagement portion 35*e* by means of the second guide rails 35*b*. Then, by closing the open/close member 34*a*, the mounting of the process cartridge B to the image forming apparatus A is completed.

{Seal Arrangements of Process Cartridge}

Figure 14:
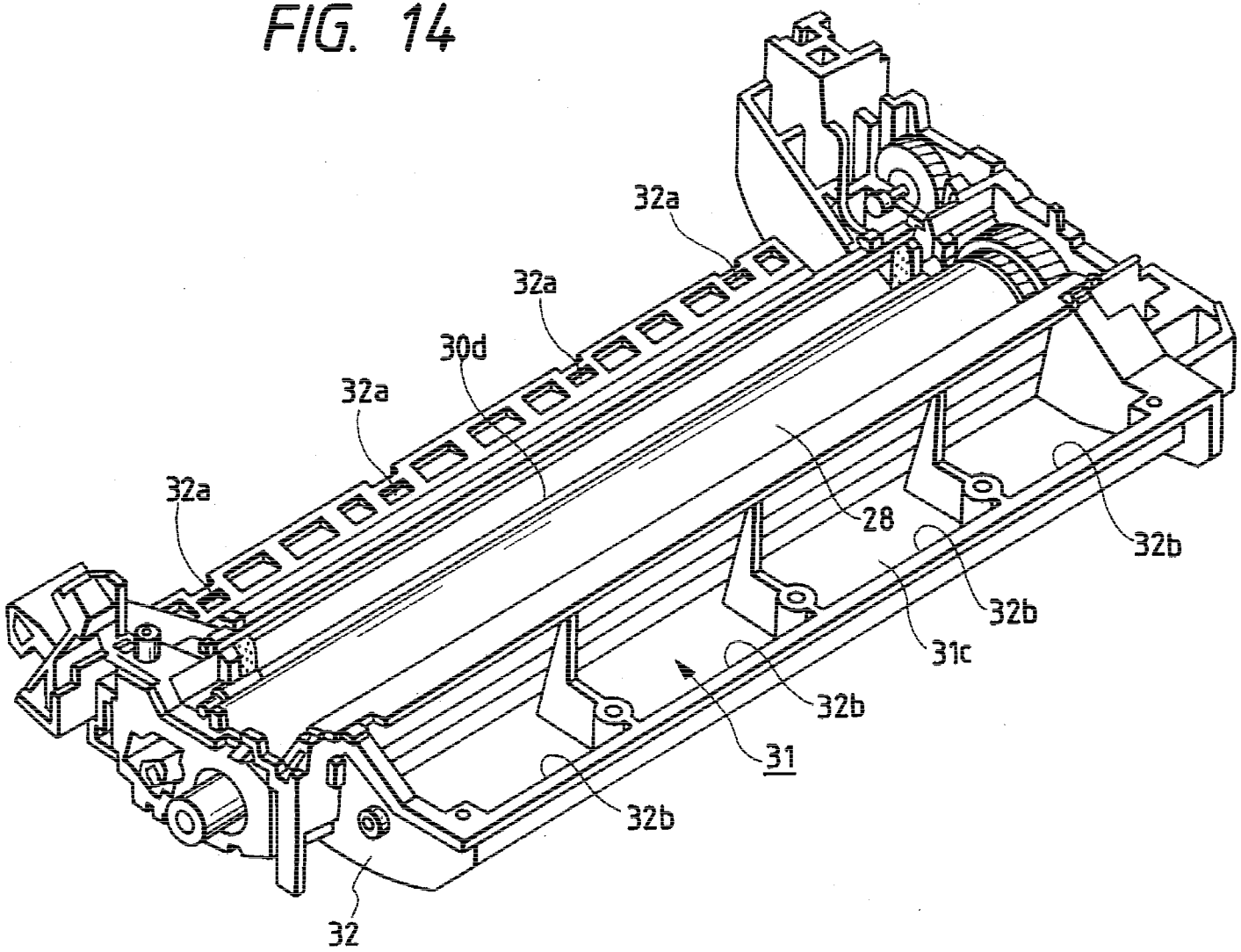
FIG. 14 is a perspective view of a lower frame.

As mentioned above, the housing of the process cartridge B is formed by interconnecting the upper and lower frames 33, 32. As shown in FIG. 14, the lower frame 32 includes the developing roller 30*d* and the developing blade 30*e* (not shown in FIG. 14) of the developing means 30 and the cleaning means 31, as well as the photosensitive drum 28. On the other hand, as shown in FIG. 15 (showing a surface of the upper frame to be connected to the lower frame 32 with facing upward), the upper frame 33 to be connected to the lower frame 32 with facing upward), the upper frame 33 includes the charge roller 29, and the toner receiving portion 30*a* and the toner feed member 30*b* (not shown in FIG. 15) of the developing means 30.

Figure 15:
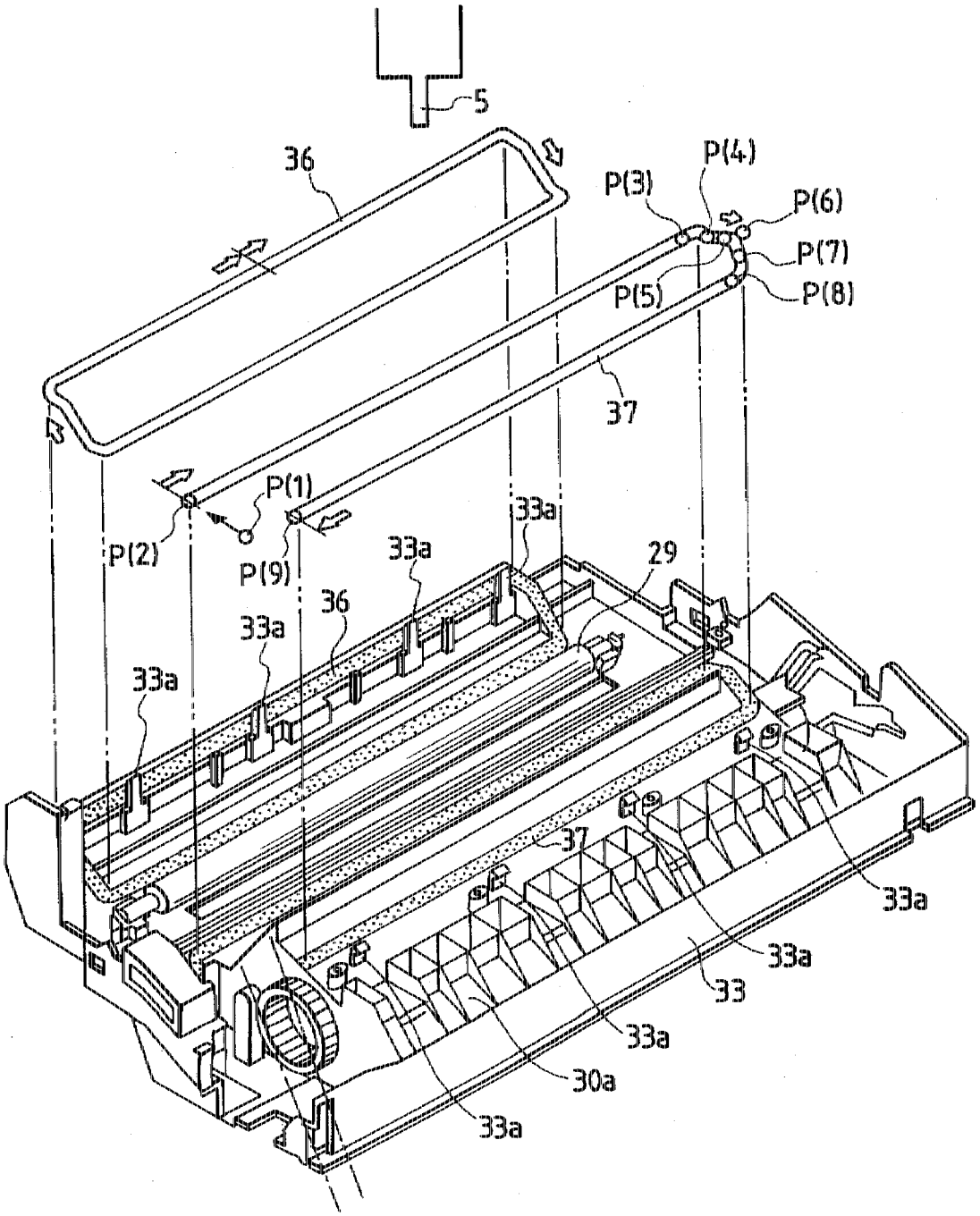
FIG. 15 is a perspective view showing an upper frame and seal members.

In order to interconnect the upper and lower frames 33, 32, as shown in FIG. 15, the upper frame 33 is provided with four pairs of integral locking pawls 33*a* equidistantly disposed substantially in a longitudinal direction. On the other hand, as shown in FIG. 14, the lower frame 32 is provided with locking holes 32*a* and locking projections 32*b* to which the locking pawls 33*a* are locked. Accordingly, when the upper and lower frames 33, 32 are forcibly engaged by each other by locking the locking pawls 33*a* to the locking holes 32*a* and the locking projections 32*b*, the upper and lower frames 33, 32 are interconnected.

When the upper and lower frames 33, 32 are interconnected in this way, it is necessary to prevent the toner from leaking through the engagement portions between the upper and lower frames. To this end, in the illustrated embodiment, the seal members are provided between the engagement portions. In the illustrated embodiment, as shown in FIG. 15, the seal members are provided on the upper frame 33. In order to automate the formation of the seal members, liquid-form material which can be solidified as elastomer after coating is injected from the above-mentioned coating apparatus onto the engagement portions to be sealed.

In the illustrated embodiment, the continuously coated and formed seal member 36 serves to prevent the toner from leaking through the engagement portion between the upper and lower frames 33, 32 regarding the cleaning means 31, and the continuously coated and formed seal member 37 serves to prevent the toner from leaking through the engagement portion between the upper and lower frames 33, 32 regarding the developing means 30. In this way, the toner can be prevented from leaking through the engagement portions between a plurality of members. Members 36 and 37 in FIG. 15 are the same as members 36 and 37 shown in FIGS. 8A and 8B.

When the seal members 36, 37 are coated and formed by the coating apparatus, the seal member 37 for the developing means 30 is coated and formed along the track shown in FIG. 8A, and the seal member 36 for the cleaning means 31 is coated and formed along the track shown in FIG. 8B. The upper frame 33 corresponds to the work 3 as shown in FIG. 1. Thus, the upper frame 33 is held by the work plate 4. By controlling the robot, the liquid-form material which can be solidified as elastomer after coating, is coated on the tracks, thereby forming the seal members 36, 37. Incidentally, the teaching points P(2)--P(9) on the program coating tracks shown in FIGS. 8A and 8B correspond to the coating tracks P(2)--P(9) for the seal members 36, 37 on the upper frame 32 shown in FIG. 15 and P(1) in FIG. 15 corresponds to P(1) in FIG. 8A. Further, by changing the coating speed along the coating tracks on the way as mentioned above, so that the coating speed is controlled to be decreased at the connecting portions between the straight tracks and the arc tracks and is also controlled at the top of the inclination in the track, the overshoot on the arc tracks can be prevented and the liquid-form material having fluidity can be coated without unevenness even on the top of the surface.

Therefore, the formation of the seal members at the engagement portions between the upper and lower frames 33, 32 can be performed with high accuracy, thereby providing a process cartridge having high sealing ability. Thus, when such a process cartridge is mounted on the image forming apparatus, a high quality image can be obtained.

Figure 16:
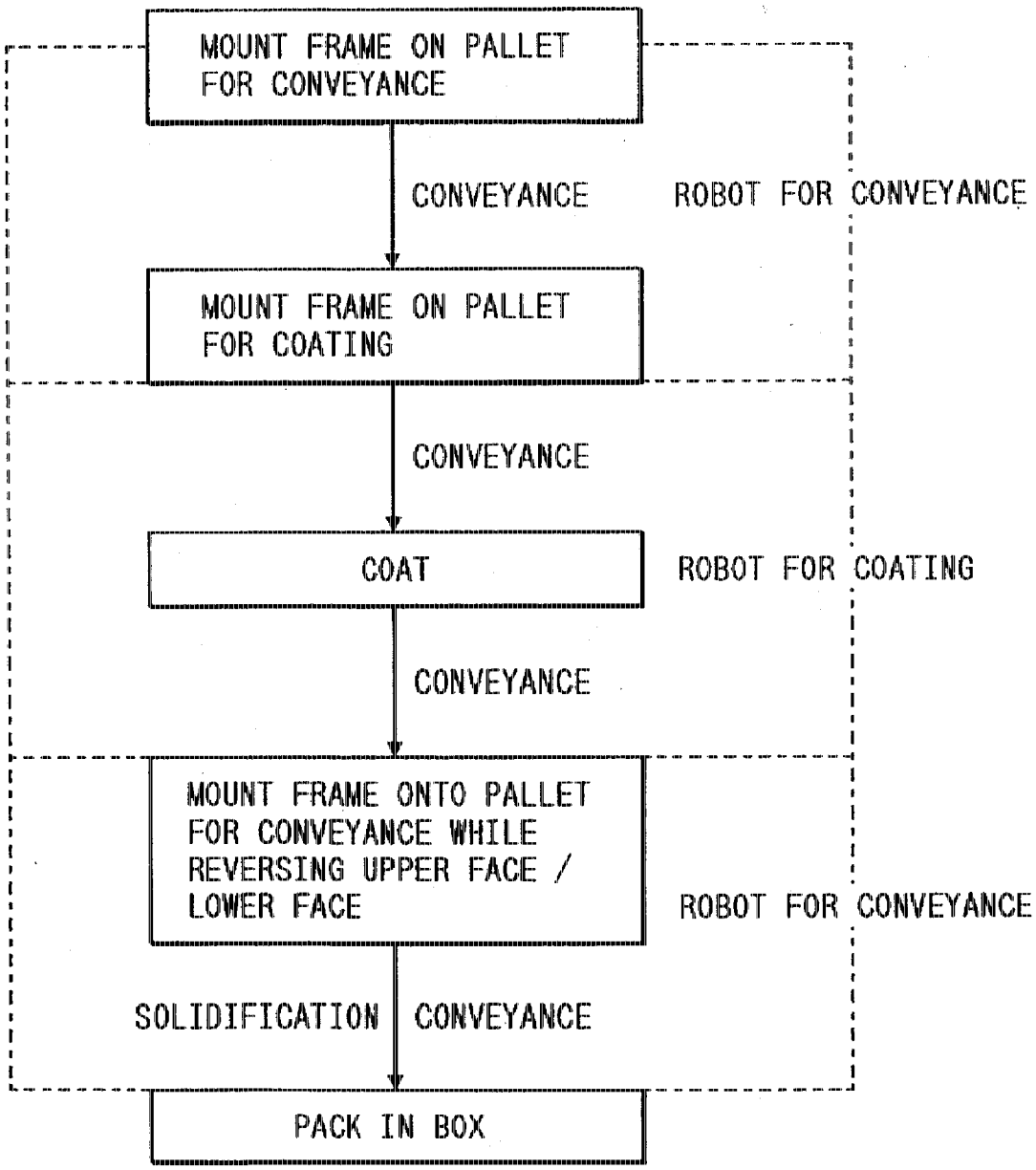
FIG. 16 is a flow chart for coating liquid-form elastomer on a frame to form a seal member.

Next, an example of a method for coating the seal member will be explained. First of all, as shown in FIG. 16, the upper frame 33 is manually picked up from a box and is mounted on a pallet for conveyance (conveying pallet), and the frame 33 together with the conveying pallet is conveyed to a position where it is associated with a robot for coating (coating robot) of the coating apparatus by means of a robot for conveyance (conveying robot). Thereafter, the frame 33 is clamped by a frame clamping means of the conveying robot and then is mounted on a pallet for coating (coating pallet). Then, the coating pallet is conveyed to a coating position by means of the coating robot.

Then, a signal is transmitted from the coating robot to an injecting device, with the result that the coating of liquid-form elastomer is effected. When the coating process is finished, the frame clamping means of the conveying robot picks up the frame 33 again, and the frame is mounted on the conveying pallet again while reversing upper face/lower face. The frame 33 mounted on the conveying pallet with the reversed upper face/lower face is conveyed for about 30 minutes; meanwhile, the liquid-form elastomer is solidified to an extent that it is not adhered to operator's fingers. Further, during the conveyance of the frame for about 30 minutes, a temperature/humidity condition is maintained to permit adequate foaming. Thereafter, the frame is manually packed in a box.

In this way, since the formation of the seal members can be automated by using the coating apparatus, the assembling of the process cartridge can be facilitated and the manufacturing cost can be reduced, with the result that the running cost of the image formation can be reduced.

{Other Embodiments Regarding Process Cartridge and the like}

In the above-mentioned embodiment, while an example that the seal members of the process cartridge are formed by the coating apparatus was explained, the coating apparatus according to the present invention is not limited to the formation of the seal members, but can be applied to the coating of liquid-form material.

Further, the process cartridge B according to the present invention is not limited to mono-color image formation, but, a plurality of developing means each including different color toner may be provided in the process cartridge to form a plural color image (for example, two-color image, three-color image or full-color image).

Further, a developing method used with the developing means may be a conventional two-component magnet brush developing method, a cascade developing method, a touch-down developing method, a cloud developing method or the like.

The photosensitive member is not limited to the photosensitive drum, but may be, for example, as follows. The photosensitive body is constituted by photo-conductor which may be, for example, amorphous silicone, amorphous selenium, zinc oxide, titanium oxide, organic photo-conductor (OPC) or the like. Further, the photosensitive body can be mounted on rotary member such as a drum, a belt and the like, or a sheet. Incidentally, in general, the drum or the belt is used. For example, in the drum type photosensitive member, the photo-conductor is deposited or coated on an aluminium alloy cylinder and the like.

In the above-mentioned embodiment, while an example that the so-called charge means is used was explained, a charger in which three walls formed from tungsten wires are covered by metallic shields such as aluminium may be used. In this case, by shifting positive or negative ions generated by applying high voltage to the tungsten wires onto the photosensitive drum, the surface of the photosensitive drum can be uniformly charged.

Incidentally, the charge means may be blade (charged blade) type, pad type, block type, rod type or wire type, as well as roller type. Further, the cleaning means for removing the residual toner from the photosensitive drum may comprise a blade, a fur brush or a magnet brush.

The process cartridge incorporates therein an electrophotographic photosensitive member, and at least one process means. Accordingly, other than the above-mentioned process cartridge, the process cartridge may incorporate therein an electrophotographic photosensitive member and a charge means as a unit which can removably be mounted to an image forming apparatus, or may incorporate therein an electrophotographic photosensitive member and a developing means as a unit which can removably be mounted to an image forming apparatus, or may incorporate therein an electrophotographic photosensitive member and a cleaning means as a unit which can removably be mounted to an image forming apparatus, or may incorporate therein an electrophotographic photosensitive member and two or more process means as a unit which can removably be mounted to an image forming apparatus.

Further, in the above-mentioned embodiment, while an example that the image forming apparatus is embodied as the laser beam printer was explained, the present invention is not limited to such an example, but may be, for example, an electrophotographic copying machine, a facsimile system a word processor or the like.

In the above-mentioned embodiment, when the liquid-form material is coated on the coated member, by changing the coating speed on the way of the continuous coating track in such a manner that the relative speed between the coating nozzle for the liquid-form material and the coated member is decreased at the connection portion from the straight track to the arc track, the overshoot in the track can be prevented. Further, when the coated member is inclined, by decreasing the coating speed at the top of the inclined surface, the coating unevenness due to the fluidity of the liquid-form material can be avoided.

Accordingly, by using the above-mentioned coating apparatus, the seal member of the process cartridge can be automatically formed with high accuracy from the liquid-form material which can be solidified as elastomer after coating. Thus, the process cartridge having no toner leakage can easily by assembled and the manufacturing cost can be reduced.

Therefore, when the image formation is performed by using such a process cartridge, the running cost can be reduced and the high quality image can be obtained.

As mentioned above, according to the present invention, the liquid-form material which can be solidified as elastomer can be coated on the coated member effectively.

What is claimed is:

1. A coating apparatus for coating liquid-form material to be solidified as an elastomer on a coated member in order to form a seal member, used in an electrophotographic image forming apparatus, for preventing toner leakage, comprising:

an injection member for injecting the liquid-form material on the coated member;

a holder for holding the coated member;

drive means for causing relative movement between said injection member and said holder; and control means for controlling said drive means to change the relative movement between said injection member and said holder, wherein said control means controls said drive means in such a manner that, when said injection member and said holder are shifted from a straight track to a curved track, the relative movement between said injection member and said holder becomes zero before said curved track, and then speeds up and slows down in said curved track.

2. A coating apparatus according to claim 1, wherein said curved track is an arc track.

3. A coating apparatus according to claim 1, wherein said control means controls said drive means in such a manner that, when said injection member and said holder are shifted on a straight track, the relative movement between said injection member and said holder speeds up and then slows down.

4. A coating apparatus according to claim 1, wherein said control means controls said drive means in such a manner that, when said injection member and said holder are shifted from a curved track to a straight track, the relative movement between said injection member and said holder speeds up in said curved track, and becomes constant and then slows down in said straight track.

5. A coating apparatus according to claim 1, wherein said control means controls said drive means in such a manner that, when said coated member is inclined, a coating speed is decreased at a top of the inclination.

6. A coating apparatus according to claim 1, wherein said curved track is an arc track.

7. A coating apparatus according to claim 1, said drive means comprising a triaxial orthogonal robot controlled by said control means.

8. A coating apparatus according to claim 1, wherein the liquid-form material is foam polyurethane.

9. A coating apparatus for coating liquid-form material to be solidified as an elastomer on a coated member in order to form a seal member, used in an electrophotographic image forming apparatus, for preventing toner leakage, comprising:

an injection member for injecting the liquid-form material on the coated member;

a holder for holding the coated member;

drive means for causing relative movement between said injection member and said holder; and control means for controlling said drive means to change the relative movement between said injection member and said holder, wherein said control means controls said drive means in such a manner that, when said injection member and said holder are shifted from a curved track to a straight track, the relative movement between said injection member and said holder speeds up in said curved track, and becomes constant and then slows down in said straight track.

10. A coating apparatus according to claim 9, wherein said control means controls said drive means in such a manner that, when said injection member and said holder are shifted on a straight track, the relative movement between said injection member and said holder speeds up and then slows down.

11. A coating apparatus according to claim 9, wherein said control means controls said drive means in such a manner that, when said coated member is inclined, a coating speed is decreased at a top of the inclination.

12. A coating apparatus according to claim 9, wherein said curved track is an arc track.

13. A coating apparatus according to claim 9, said drive means comprising a triaxial orthogonal robot controlled by said control means.

14. A coating apparatus according to claim 9, wherein the liquid-form material is foam polyurethane.

15. A coating apparatus for coating liquid-form material to be solidified as an elastomer on a coated member in order to form a seal member, used in an electrophotographic image forming apparatus, for preventing toner leakage, comprising:

an injection member for injecting the liquid-form material on the coated member;

a holder for holding the coated member;

drive means for causing relative movement between said injection member and said holder; and control means for controlling said drive means to change the relative movement between said injection member and said holder, wherein said control means controls said drive means in such a manner that, when said coated member is inclined, a coating speed is decreased at a top of the inclination.

16. A coating apparatus according to claim 15, wherein said control means controls said drive means in such a manner that, when said injection member and said holder are shifted on a straight track, the relative movement between said injection member and said holder speeds up and then slows down.

17. A coating apparatus according to claim 15, wherein said control means control said drive means so that said injection member and said holder are shifted to a curved track, wherein said curved track is an arc track.

18. A coating apparatus according to claim 15, said drive means comprising a triaxial orthogonal robot controlled by said control means.

19. A coating apparatus according to claim 15, wherein the liquid-form material is foam polyurethane.

20. A coating apparatus for coating liquid-form material to be solidified as an elastomer on a coated member in order to form a seal member, used in an electrophotographic image forming apparatus, for preventing toner leakage, comprising:

an injection member for injecting the liquid-form material on the coated member;

a holder for holding the coated member;

drive means for causing relative movement between said injection member and said holder; and control means for controlling said drive means to change the relative movement between said injection member and said holder, wherein said drive means comprises a triaxial orthogonal robot, wherein said triaxial orthogonal robot has an X-axis arm, a Y-axis arm and a Z-axis arm so that a three-dimensional shape can be drawn by a tip end of said Z-axis arm by controlling said three arms, and wherein the tip end of said Z-axis arm is provided with a reversing unit on which a work plate acting as said holder is attached, and a seal agent injecting device is provided so that an injecting nozzle acting as said injection member is positioned above said work plate, whereby the seal agent can be coated on a coated surface on said work plate by shifting said arm along any track while injecting the seal agent from said injecting nozzle.

21. A coating apparatus according to claim 20, wherein said coated member is a process cartridge removably mounted to a main body of the electrophotographic image forming apparatus, wherein said coated member is a cartridge frame of said process cartridge removably mounted to the main body of the electrophotographic image forming apparatus.

22. A coating apparatus according to claim 20, wherein said control means controls said drive means in such a manner that, when said injection member and said holder are shifted on a straight track, the relative movement between said injection member and said holder speeds up and then slows down.

23. A coating apparatus according to claim 20, wherein said control means controls said drive means in such a manner that, when said injection member and said holder are shifted from a straight track to a curved track, the relative movement between said injection member and said holder becomes zero before said curved track, and then speeds up and slows down in said curved track.

24. A coating apparatus according to claim 20, wherein said control means controls said drive means in such a manner that, when said injection member and said holder are shifted from a curved track to a straight track, the relative movement between said injection member and said holder speeds up in said curved track, and becomes constant and then slows down in said straight track.

25. A coating apparatus according to claim 24, wherein said curved track is an arc track.

26. A coating apparatus according to claim 20, wherein said control means controls said drive means in such a manner that, when said coated member is inclined, a coating speed is decreased at a top of the inclination.

27. A coating apparatus according to claim 20, wherein the liquid-form material is foam polyurethane.

28. A coating apparatus for coating liquid-form material to be solidified as an elastomer on a cartridge frame of a process cartridge in order to form a seal member for preventing toner leakage, said process cartridge including a drum-shaped electrophotographic photosensitive member, a developing roller for developing a latent image formed on said drum-shaped electrophotographic photosensitive member and for supplying toner to said electrophotographic photosensitive member by its own rotation, a charge roller contacting said drum-shaped electrophotographic photosensitive member and adapted to charge said drum-shaped electrophotographic photosensitive member, and a cleaning blade contacting said drum-shaped electrophotographic photosensitive member and adapted to remove residual toner remaining on said electrophotographic photosensitive member, said coating apparatus comprising:

a nozzle for injecting a foam polyurethane as the liquid-form material on said cartridge frame;

a holder for holding said cartridge frame;

a robot for shifting said holder with respect to said nozzle, said robot being a triaxial orthogonal robot having an X-axis arm, a Y-axis arm and a Z-axis arm; and control means for controlling said robot to change the shifting speed of said holder, said control means including a CPU for effecting analysis/calculation for controlling said robot, a ROM for storing a program executed by said CPU, a RAM for storing data, a timer for measuring time, a bus for communication of the data, motor means for driving said robot, motor driver means for driving said motor means, and encoder means for detecting the position of said motor means;

wherein said control means controls said robot in such a manner that, when said holder is shifted on a straight track, the shifting speed of said holder speeds up and then slows down, and when said holder is shifted from a straight track to a curved track, the shifting speed of said holder becomes zero before said curved track, and then speeds up and slows down in said curved track, and when said holder is shifted from a curved track to a straight track, the shifting speed of said holder speeds up in said curved track, and becomes constant and then slows down in said straight track, and, when a coated surface is inclined, a coating speed is decreased at a top of the inclination.

29. A process cartridge which is removably mounted to a main body of an electrophotographic image forming apparatus, comprising:

(a) a drum-shaped electrophotographic photosensitive member;

(b) a developing roller for developing a latent image formed on said drum-shaped electrophotographic photosensitive member and for supplying toner to said electrophotographic photosensitive member by its rotation;

(c) a charge roller contacting said drum-shaped electrophotographic photosensitive member to charge said electrophotographic photosensitive member;

(d) a cleaning blade contacting said drum-shaped electrophotographic photosensitive member to remove residual toner remaining on said electrophotographic photosensitive member; and (e) a seal member provided for preventing the toner from leaking from a predetermined area;

wherein (f) said seal member is formed from an elastomer obtained by solidifying liquid-form material coated by a coating apparatus, said coating apparatus including:

a nozzle for injecting foam polyurethane as the liquid-form material on said cartridge frame;

a holder for holding said cartridge frame;

a robot for shifting said holder with respect to said nozzle, said robot being a triaxial orthogonal robot having an X-axis arm, a Y-axis arm and a Z-axis arm; and control means for controlling said robot to change the shifting speed of said holder, said control means including a CPU for effecting analysis/calculation for controlling said robot, a ROM for storing a program executed by said CPU, a RAM storing data, a timer for measuring time, a bus for communication of the data, motor means for driving said robot, motor driver means for driving said motor means, and encoder means for detecting the position of said motor means;

wherein said control means controls said robot in such a manner that, when said holder is shifted on a straight track, the shifting speed of said holder speeds up and then slows down, and when said holder is shifted from a straight track to a curved track, the shifting speed of said holder becomes zero before said curved track, and then speeds up and slows down in said curved track, and when said holder is shifted from a curved track to a straight track, the shifting speed of said holder speeds up in said curved track, and becomes constant and then slows down in said straight track, and when a coated surface is inclined, a coating speed is decreased at a top of the inclination.

30. An electrophotographic image forming apparatus to which a process cartridge can removably be mounted and which is adapted to form an image on a recording medium, comprising:

(A) mounting means capable of removably mounting a process cartridge including a drum shaped electrophotographic photosensitive member, a developing roller for developing a latent image formed on said drum-shaped electrophotographic photosensitive member and for supplying toner to said electrophotographic photosensitive member by its rotation, a charge roller contacting said drum-shaped electrophotographic photosensitive member and adapted to charge said electrophotographic photosensitive member, a cleaning blade contacting said drum-shaped electrophotographic photosensitive member to remove residual toner remaining on said electrophotographic photosensitive member, and a seal member provided for preventing the toner from leaking from a predetermined area, said seal member being formed from an elastomer obtained by solidifying liquid-form material coated by a coating apparatus, said coating apparatus including a nozzle for injecting foam polyurethane as the liquid-form material on said cartridge frame, a holder for holding said cartridge frame, a robot for shifting said holder with respect to said nozzle, said robot being a triaxial orthogonal robot having an X-axis arm, a Y-axis arm and a Z-axis arm, and control means for controlling said robot to change the shifting speed of said holder, said control means including a CPU for effecting analysis/calculation for controlling said robot, a ROM for storing a program executed by said CPU, a RAM for storing data, a timer for measuring time, a bus for communication of the data, motor means for driving said robot, motor driver means for driving said motor means, and encoder means for detecting the position of said motor means, said control means controlling said robot in such a manner that, when said holder is shifted on a straight track, the shifting speed of said holder speeds up and then slows down, and when said holder is shifted from a straight track to a curved track, the shifting speed of said holder becomes zero before said curved track, and then speeds up and slows down in said curved track, and when said holder is shifted from a curved track to a straight track, the shifting speed of said holder speeds up in said curved track, and becomes constant and then slows down in said straight track, and when a coated surface is inclined, a coating speed is decreased at a top of the inclination; and (B) convey means for conveying the recording medium.

31. A coating apparatus for coating liquid-form material to be solidified as an elastomer on a coated member in order to form a seal member, used in an electrophotographic image forming apparatus, for preventing toner leakage, comprising:

an injection member for injecting the liquid-form material on the coated member;

a holder for holding the coated member;

drive means for causing relative movement between said injection member and said holder, said drive means comprising a robot; and control means for controlling said drive means to change the relative movement between said injection member and said holder, wherein said control means includes a CPU for effecting analysis/calculation for controlling said drive means, a ROM for storing a program executed by said CPU, a RAM for storing data, a timer for measuring time, a bus for communication of the data, motor means for driving said robot, motor driver means for driving said motor means, and encoder means for detecting a position of said motor means, wherein said coated member is a process cartridge removably mounted to a main body of the electrophotographic image forming apparatus, and wherein said coated member is a cartridge frame of said process cartridge assembly removably mounted to the main body of the electrophotographic image forming apparatus.

32. A coating apparatus according to claim 31, wherein said control means controls said drive means in such a manner that, when said injection member and said holder are shifted on a straight track, the relative movement between said injection member and said holder speeds up and then slows down.

33. A coating apparatus according to claim 31, wherein said control means controls said drive means in such a manner that, when said injection member and said holder are shifted from a straight track to a curved track, the relative movement between said injection member and said holder becomes zero before said curved track, and then speeds up and slows down in said curved track.

34. A coating apparatus according to claim 31, wherein said control means controls said drive means in such a manner that, when said injection member and said holder are shifted from a curved track to a straight track, the relative movement between said injection member and said holder speeds up in said curved track, and becomes constant and then slows down in said straight track.

35. A coating apparatus according to claim 34, wherein said curved track is an arc track.

36. A coating apparatus according to claim 31, wherein said control means controls said drive means in such a manner that, when said coated member is inclined, a coating speed is decreased at a top of the inclination.

37. A coating apparatus according to claim 31, said drive means comprising a triaxial orthogonal robot.

38. A coating apparatus according to claim 31, wherein the liquid-form material is foam polyurethane.

* * * * *

UNITED STATES PATENT AND TRADEMARK OFFICE

CERTIFICATE OF CORRECTION

PATENT NO. : 5,708,913

DATED : January 13, 1998

INVENTOR(S) : Yasuhara et al.

It is certified that error appears in the above-identified patent and that said Letters Patent is hereby corrected as shown below:

COLUMN 1:

Line 55, "MOLTPLANE" should read --MOLT PLANE--.

COLUMN 5:

Line 55, "slowing down" should read --the slowing down--.

Signed and Sealed this

Twenty-ninth Day of September, 1998

Bruce Lehman

*Attest:*

BRUCE LEHMAN

*Attesting Officer*

*Commissioner of Patents and Trademarks*